US009145730B1

(12) United States Patent
Santamaria

(10) Patent No.: US 9,145,730 B1
(45) Date of Patent: Sep. 29, 2015

(54) SECURITY SHUTTERS FOR WINDOW AND DOOR OPENINGS

(71) Applicant: Robert Santamaria, Harwinton, CT (US)

(72) Inventor: Robert Santamaria, Harwinton, CT (US)

( * ) Notice: Subject to any disclaimer, the term of this patent is extended or adjusted under 35 U.S.C. 154(b) by 0 days.

(21) Appl. No.: 14/501,267

(22) Filed: Sep. 30, 2014

(51) Int. Cl.

| | |
|---|---|
| ***E05B 65/04*** | (2006.01) |
| ***E06B 5/11*** | (2006.01) |
| ***E06B 7/28*** | (2006.01) |
| ***E06B 9/00*** | (2006.01) |
| ***E06B 9/02*** | (2006.01) |
| ***E06B 3/46*** | (2006.01) |

(52) U.S. Cl.
CPC ..... *E06B 5/11* (2013.01); *E06B 3/4609* (2013.01); *E06B 3/4636* (2013.01); *E06B 7/28* (2013.01); *E06B 9/00* (2013.01); *E06B 9/02* (2013.01); *E06B 2009/002* (2013.01); *E06B 2009/005* (2013.01)

(58) Field of Classification Search
CPC ..... E06B 9/04; E06B 2009/005; E06B 5/10; E06B 5/11
USPC ..... 49/61, 63, 68, 409
See application file for complete search history.

(56) References Cited

U.S. PATENT DOCUMENTS

| | | | | |
|---|---|---|---|---|
| 1,485,200 | A * | 2/1924 | Roberts | 49/409 |
| 3,452,477 | A * | 7/1969 | Sassano | 49/116 |
| 4,031,664 | A * | 6/1977 | Wendt | 49/409 |
| 4,630,396 | A | 12/1986 | Zvi | |
| 4,967,509 | A | 11/1990 | Storey | |
| 4,993,187 | A | 2/1991 | Schweiss | |
| 5,289,655 | A | 3/1994 | Marmora et al. | |
| 5,490,353 | A | 2/1996 | McLaughlin | |
| 5,855,099 | A * | 1/1999 | Hoffman | 52/202 |
| 7,412,799 | B1 | 8/2008 | Aguirre | |
| 7,584,579 | B1 * | 9/2009 | Everitt | 52/202 |
| 7,793,463 | B1 | 9/2010 | Stansberry | |
| 7,805,898 | B1 * | 10/2010 | Everitt | 52/202 |
| 7,827,744 | B2 * | 11/2010 | Wenrick et al. | 52/202 |
| 2007/0084138 | A1 * | 4/2007 | Cassista et al. | 52/202 |
| 2009/0090062 | A1 | 4/2009 | Pandorf | |
| 2010/0101150 | A1 * | 4/2010 | Huang | 49/409 |

* cited by examiner

*Primary Examiner* — Katherine Mitchell
*Assistant Examiner* — Abe Massad

(57) ABSTRACT

The security shutters for window and door openings is constructed of a guide rail that is configured to be secured above a door or window opening. A left shutter and a right shutter are rollably attached to the guide rail such that the left shutter and/or right shutter are able to slide along the guide rail in order to cover or expose the door or window opening. The left shutter and the right shutter each include at least one roller bracket affixed to a top distal edge, which includes a roller wheel distally located thereto. The roller wheel is nested inside of the guide rail such that the left shutter or right shutter is able to slide along a guide rail length.

11 Claims, 5 Drawing Sheets

SECURITY SHUTTERS FOR WINDOW AND DOOR OPENINGS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of security shutters, more specifically, a set of security shutters that are configured for use with either a window or door.

SUMMARY OF THE INVENTION

The security shutters for window and door openings is constructed of a guide rail that is configured to be secured above a door or window opening. A left shutter and a right shutter are rollably attached to the guide rail such that the left shutter and/or right shutter are able to slide along the guide rail in order to cover or expose the door or window opening. The left shutter and the right shutter each include at least one roller bracket affixed to a top distal edge, which includes a roller wheel distally located thereto. The roller wheel is nested inside of the guide rail such that the left length. A securing bracket is adapted to be secured underneath the window or door opening. The securing bracket is detached from underneath window or door opening and is secured to the left shutter and right shutter as well as to a wall surface underneath the window or door opening. A plurality of fasteners are employed to secure the securing bracket to both the wall surface as well as the left shutter and right shutter. The left shutter and the right shutter each include a plurality of fastener holes along a bottom, distal end. The plurality of fastener holes correspond with mounting bracket holes provided on the securing bracket. When in use, the left shutter and right shutter are secured over the window or door opening via the fasteners and the securing bracket, and or optionally unsecured thereto such that the left shutter and right shutter are able to roll along the guide rail in order to expose the window or door opening.

These together with additional objects, features and advantages of the security shutters for window and door openings will be readily apparent to those of ordinary skill in the art upon reading the following detailed description of presently preferred, but nonetheless illustrative, embodiments of the security shutters for window and door openings when taken in conjunction with the accompanying drawings.

In this respect, before explaining the current embodiments of the security shutters for window and door openings in detail, it is to be understood that the security shutters for window and door openings is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the security shutters for window and door openings.

It is therefore important that the claims be regarded as including such equivalent construction insofar as they do not depart from the spirit and scope of the security shutters for window and door openings. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
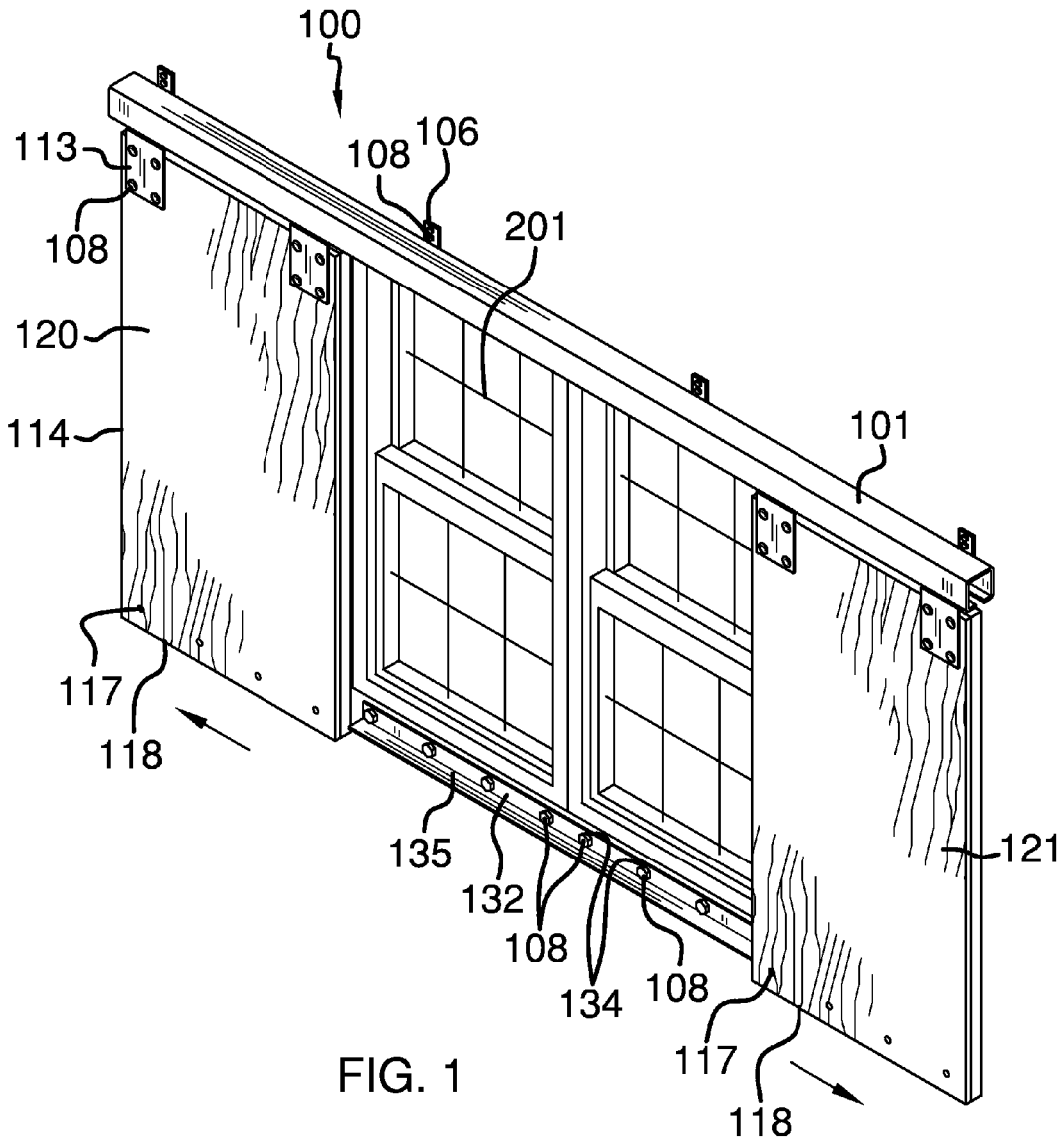
FIG. 1 illustrates a perspective view of an embodiment of the disclosure in use with a window, and in an open position.
Figure 2:
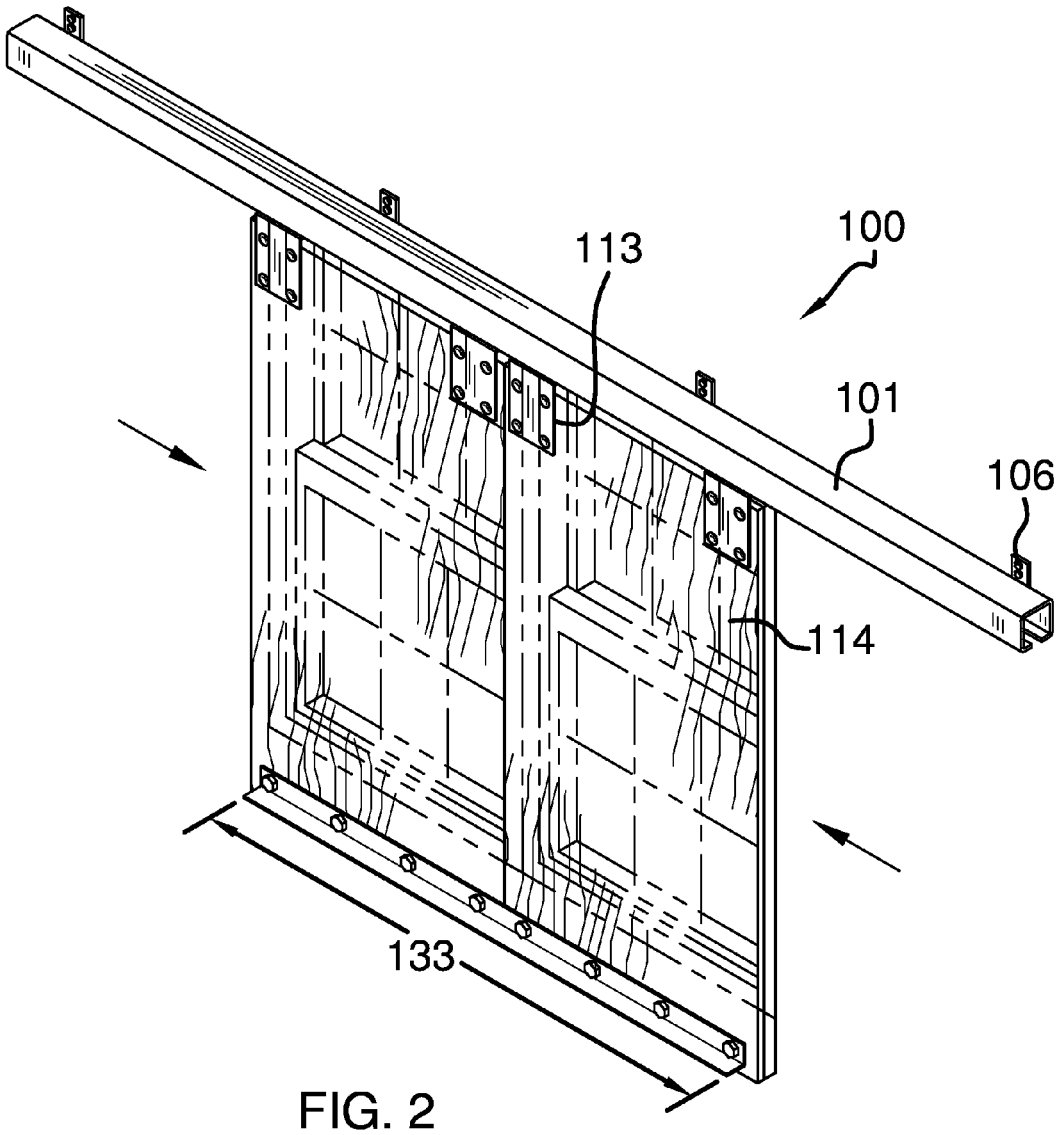
FIG. 2 illustrates a perspective view of an embodiment of the disclosure in use with a window, and in a closed position.
Figure 3:
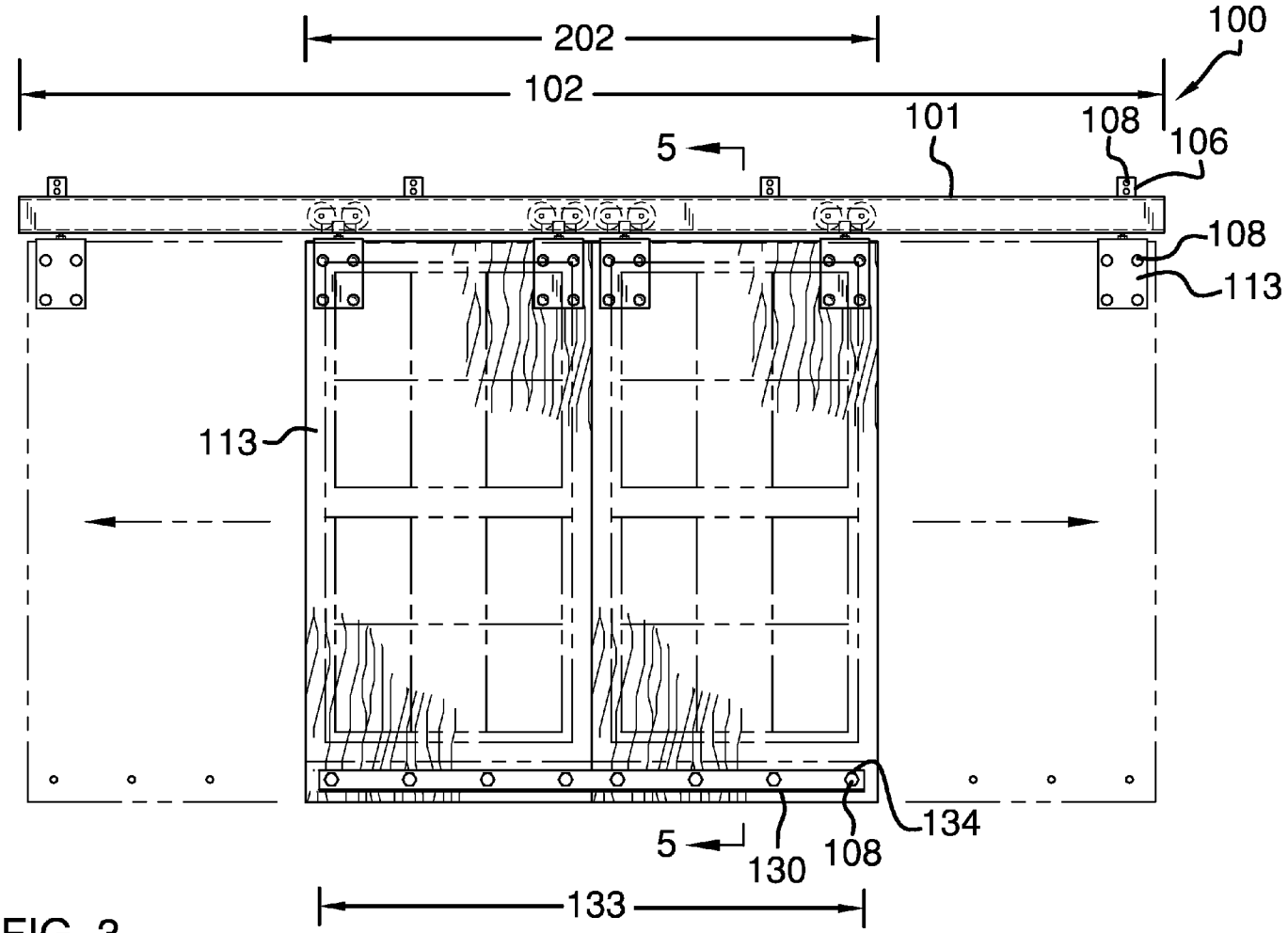
FIG. 3 illustrates a front view of an embodiment of the disclosure.
Figure 4:
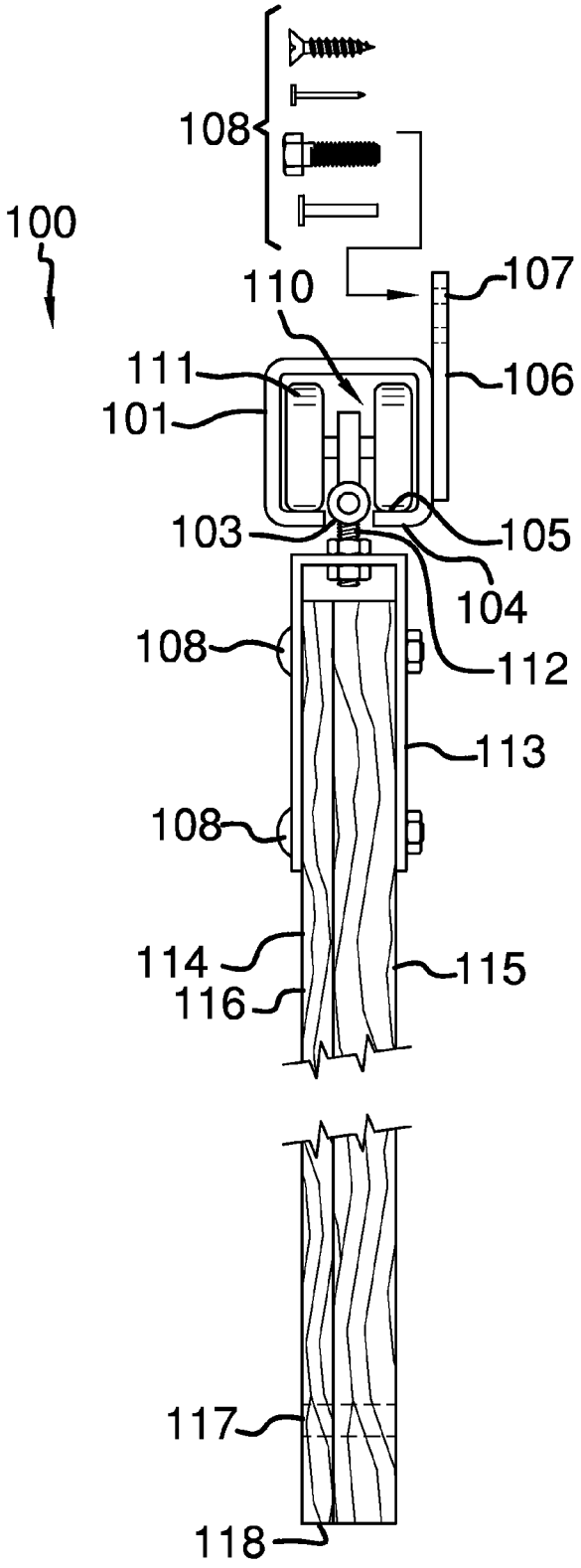
FIG. 4 illustrates a side view of an embodiment of the disclosure.
Figure 5:
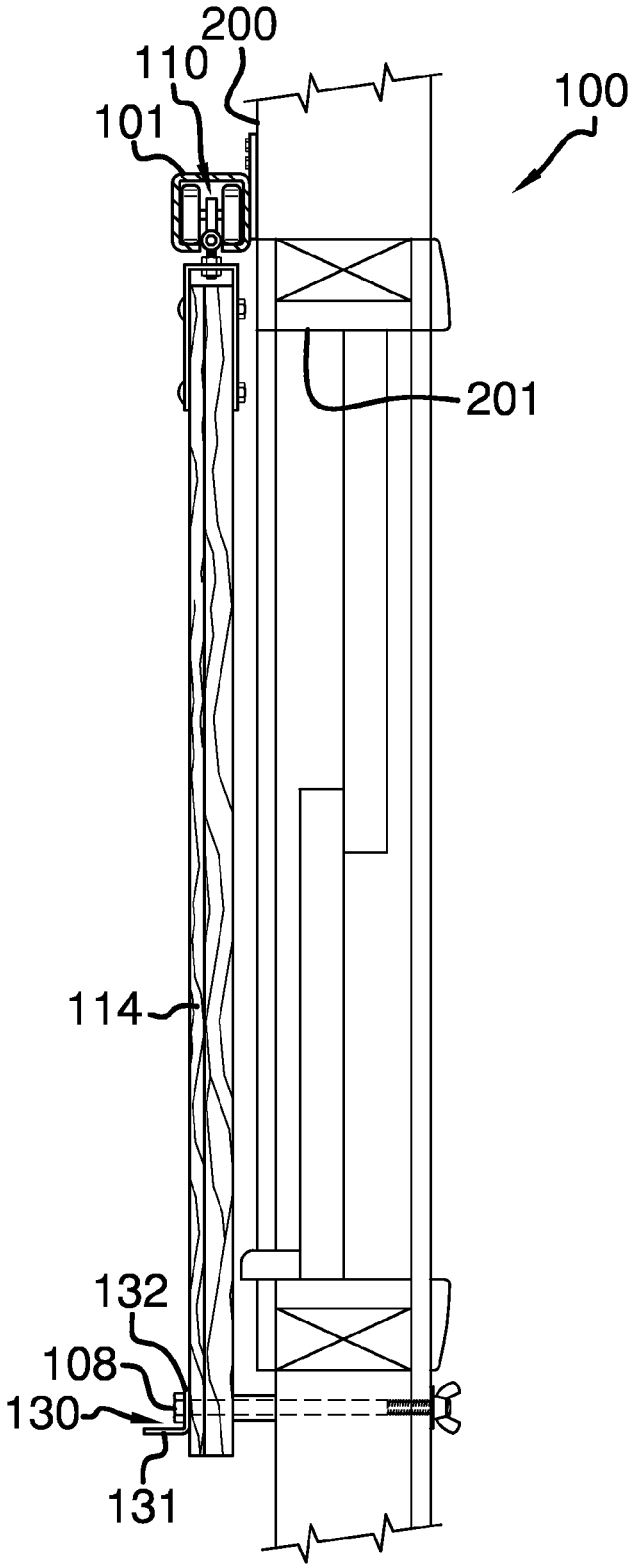
FIG. 5 illustrates a cross-sectional view along line 5-5 in FIG. 3.

Detailed reference will now be made to the preferred embodiment of the present invention, examples of which are illustrated in FIGS. 1-5. A security shutters for window and door openings 100 (hereinafter invention) is further defined with a guide rail 101 that is configured to be secured to a wall surface 200 just above a door or window opening 201. The guide rail 101 has a guide rail length 102 that is greater than an opening length 202. The guide rail 101 is further defined with a generally square cross-section having a slot 103 provided on a bottom guide rail surface 104. The slot 103 enables a roller wheel assembly 110 to slide along an inner guide rail surface 105. The roller wheel assembly 110 includes at least one wheel 111 that rolls along the inner guide rail surface 105. The guide rail 101 includes at least one guide rail mounting bracket 106 that includes at least one guide mounting hole 107 used to secure the guide rail mounting bracket 106 to the wall surface 200 via a fastener 108. The fastener 108 comprises the use of a bolt, nail, screw, rivet, etc.

The roller wheel assembly 110 includes a roller assembly bolt 112 that extends downwardly through the slot 103. The roller assembly bolt 112 is secured to a roller assembly bracket 113 that is affixed to a shutter 114. The roller assembly bracket 113 is an inverted "U" shaped bracket that secures itself onto the shutter 114 via fasteners 108. Moreover, the roller assembly bracket 113 is affixed on an inner shutter surface 115 of the shutter 114 as well as an outer shutter surface 116 of the shutter 114. The shutter 114 is able to dangle from underneath the guide rail 101. Moreover, the roller wheel assembly 110 enables the shutter 114 to slide back and forth across the door or window opening 201 in order to either cover or expose the door or window opening 201.

The invention 100 employs the use of at least one of the shutters 114. Moreover, the shutter 114 may be defined with a left shutter 120 and a right shutter 121. The invention 100 includes a securing bracket 130. The securing bracket 130 is used to lock the shutter 114 over the door or window opening 201. When the shutter 114 is to leave the door or window opening 201 exposed, the securing bracket 130 is adapted to be secured to the wall surface 200 immediately underneath the door or window opening 201. The securing bracket 130 is further defined with a horizontal member 131 and a vertical member 132. The securing bracket 130 includes a securing length 133 that is equal to or less than the opening length 202.

The securing bracket 130 includes at least one securing hole 134 on the vertical member 132. The at least one securing hole 134 is used in conjunction with the fastener 108 to secure the securing bracket 130 directly to the wall surface 200 when the shutter 114 is not covering the window or door opening 201. It shall be noted that the shutter 114 includes at least one shutter hole 117. The at least one shutter hole 117 is adjacent to a bottom shutter edge 118. The at least one shutter hole 117 is used in connection with and corresponds to the at least one securing hole 134 of the securing bracket 130, and in conjunction with the wall surface 200.

The securing bracket 130 enables the shutter 113 to be locked over the door or window opening 201 in order to protect the door or window opening 201 against the elements for prolonged periods of time.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A security shutter assembly for window and door openings comprising:

at least one shutter rollably attached to a guide rail;

said guide rail is adapted to be secured to a wall surface;

said guide rail is adapted to be positioned above a door or window opening such that the at least one shutter is able to roll along the guide rail in order to either cover or expose said door or window opening;

wherein a securing bracket is selectively employed in order to fasten the at least one shutter in adaptive arrangement with said wall surface;

said securing bracket is adaptively fastened to said wall surface below said door or window opening;

wherein the guide rail has a guide rail length that is greater than an opening length of said door or window opening;

wherein the guide rail is further defined with a generally square cross-section having a slot provided on a bottom guide rail surface; wherein the slot enables a roller wheel assembly to slide along an inner guide rail surface;

wherein the roller wheel assembly includes at least one wheel that rolls along the inner guide rail surface;

wherein the guide rail includes at least one guide rail mounting bracket that includes at least one guide mounting hole used to secure the guide rail mounting bracket to the wall surface via at least one fastener;

wherein the roller wheel assembly includes a roller assembly bolt that extends downwardly through the slot;

wherein the roller assembly bolt is secured to a roller assembly bracket that is affixed to the at least one shutter;

wherein the roller assembly bracket is an inverted "U" shaped bracket that secures itself onto the at least one shutter via the at least one fastener;

wherein when the shutter is not covering the door or window opening, the securing bracket is fastened such that the securing bracket is in direct contact with the wall surface, and when the shutter is secured in a position covering the door or window opening, the securing bracket is positioned away from the wall surface such that the securing bracket is not in direct contact with the wall surface and the shutter is fastened between the wall surface and the securing bracket.

2. The security shutter assembly for window and door openings as described in claim 1 wherein the at least one fastener comprises the use of a bolt, nail, screw, or rivet.

3. The security shutter assembly for window and door openings as described in claim 1 wherein the roller assembly bracket is affixed on an inner shutter surface of the at least one shutter as well as an outer shutter surface of the at least one shutter.

4. The security shutter assembly for window and door door openings as described in claim 3 wherein the shutter is able to dangle from underneath the guide rail; wherein the roller wheel assembly enables the shutter to slide back and forth across the door or window opening in order to either cover or expose the door or window opening.

5. The security shutter assembly for window and door openings as described in claim 4 wherein the securing bracket is further defined with a horizontal member and a vertical member; wherein the securing bracket includes a securing length that is equal to or less than the opening length.

6. The security shutter assembly for window and door openings as described in claim 5 wherein the securing bracket includes at least one securing hole on the vertical member; wherein the at least one securing hole is used in conjunction with the at least one fastener to secure the securing bracket directly to the wall surface when the at least one shutter is not covering the window or door opening.

7. The security shutter assembly for window and door openings as described in claim 6 wherein the at least one shutter includes at least one shutter hole; wherein the at least one shutter hole is adjacent to a bottom shutter edge; wherein the at least one shutter hole is used in connection with and corresponds to the at least one securing hole of the securing bracket.

8. A security shutter assembly for window and door openings comprising:

at least one shutter rollably attached to a guide rail;

said guide rail is adapted to be secured to a wall surface;

said guide rail is adapted to be positioned above a door or window opening such that the at least one shutter is able to roll along the guide rail in order to either cover or expose said door or window opening;

wherein a securing bracket is selectively employed in order to fasten the at least one shutter in adaptive arrangement with said wall surface;

said securing bracket is adaptively fastened to said wall surface below said door or window opening;

wherein the guide rail has a guide rail length that is greater than an opening length of said door or window opening;

wherein the guide rail is further defined with a generally square cross-section having a slot provided on a bottom guide rail surface; wherein the slot enables a roller wheel assembly to slide along an inner guide rail surface;

wherein the roller wheel assembly includes at least one wheel that rolls along the inner guide rail surface; wherein the guide rail includes at least one guide rail mounting bracket that includes at least one guide mounting hole used to secure the guide rail mounting bracket to the wall surface via at least one fastener;

wherein the roller wheel assembly includes a roller assembly bolt that extends downwardly through the slot; wherein the roller assembly bolt is secured to a roller assembly bracket that is affixed to the at least one shutter; wherein the roller assembly bracket is an inverted "U" shaped bracket that secures itself onto the at least one shutter via the at least one fastener;

wherein the roller assembly bracket is affixed on an inner shutter surface of the at least one shutter as well as an outer shutter surface of the at least one shutter; wherein the shutter is able to dangle from underneath the guide rail; wherein the roller wheel assembly enables the shutter to slide back and forth across the door or window opening in order to either cover or expose the door or window opening;

wherein when the shutter is not covering the door or window opening, the securing bracket is fastened such that the securing bracket is in direct contact with the wall surface, and when the shutter is secured in a position covering the door or window opening, the securing bracket is positioned away from the wall surface such that the securing bracket is not in direct contact with the wall surface and the shutter is fastened between the wall surface and the securing bracket.

9. The security shutter assembly for window and door openings as described in claim 8 wherein the at least one fastener comprises the use of a bolt, nail, screw, rivet, or rivet.

10. The security shutter assembly for window and door openings as described in claim 8 wherein the securing bracket is further defined with a horizontal member and a vertical member; wherein the securing bracket includes a securing length that is equal to or less than the opening length; wherein the securing bracket includes at least one securing hole on the vertical member; wherein the at least one securing hole is used in conjunction with the fastener to secure the securing bracket directly to the wall surface when the at least one shutter is not covering the window or door opening.

11. The security shutter assembly for window and door openings as described in claim 10 wherein the at least one shutter includes at least one shutter hole; wherein the at least one shutter hole is adjacent to a bottom shutter edge; wherein the at least one shutter hole is used in connection with and corresponds to the at least one securing hole of the securing bracket.

* * * * *